United States Patent [19]

Catalo

[11] Patent Number: 4,836,565

[45] Date of Patent: Jun. 6, 1989

[54] SUITCASE FOR ARRANGING GOLF EQUIPMENT, CONVERTIBLE TO A GOLF CART

[76] Inventor: Irénée Catalo, 4, avenue de l'Egalité, 81300 Graulhet, France

[21] Appl. No.: 132,973

[22] Filed: Dec. 15, 1987

[30] Foreign Application Priority Data

Dec. 15, 1986 [FR] France ..... 8617628

[51] Int. Cl.[4] ..... B62B 1/04

[52] U.S. Cl. ..... 280/37; 280/47.26; 280/DIG. 6; 206/315.2

[58] Field of Search ..... 280/37, 651, 652, 47.17, 280/47.18, 47.24, 47.26, DIG. 6, DIG. 5, 395.2; 206/315.3, 315.4, 315.6, 315.8

[56] References Cited

U.S. PATENT DOCUMENTS 2,590,178 3/1952 Jamison ..... 280/37

3,147,022 9/1964 Amendola ..... 280/37

4,629,202 12/1986 Nelson et al. ..... 280/47.26

*Primary Examiner*—Charles A. Marmor

*Assistant Examiner*—Richard Camby

*Attorney, Agent, or Firm*—Harold H. Dutton, Jr.

[57] ABSTRACT

The invention relates to a suitcase for arranging golf equipment, of a type convertible to a cart for transporting the equipment over a golf coarse. This suitcase has a covering defining a parrallelepipedic volume and is made up of a removeable top face (1), a pair of end walls, a pair of side walls and a large bottom face. The covering is rigidly positioned by an internal reinforcing structure (8) that is connected to internal reinforcing walls (9, 10) that are transverse to the cart. A longitudinal standard (15) is fixed to the transverse walls (9, 10). A transverse axle (19) is fixed to the standard (15) and has ends that removeable attach two wheels.

11 Claims, 5 Drawing Sheets

SUITCASE FOR ARRANGING GOLF EQUIPMENT, CONVERTIBLE TO A GOLF CART

Figure 1:
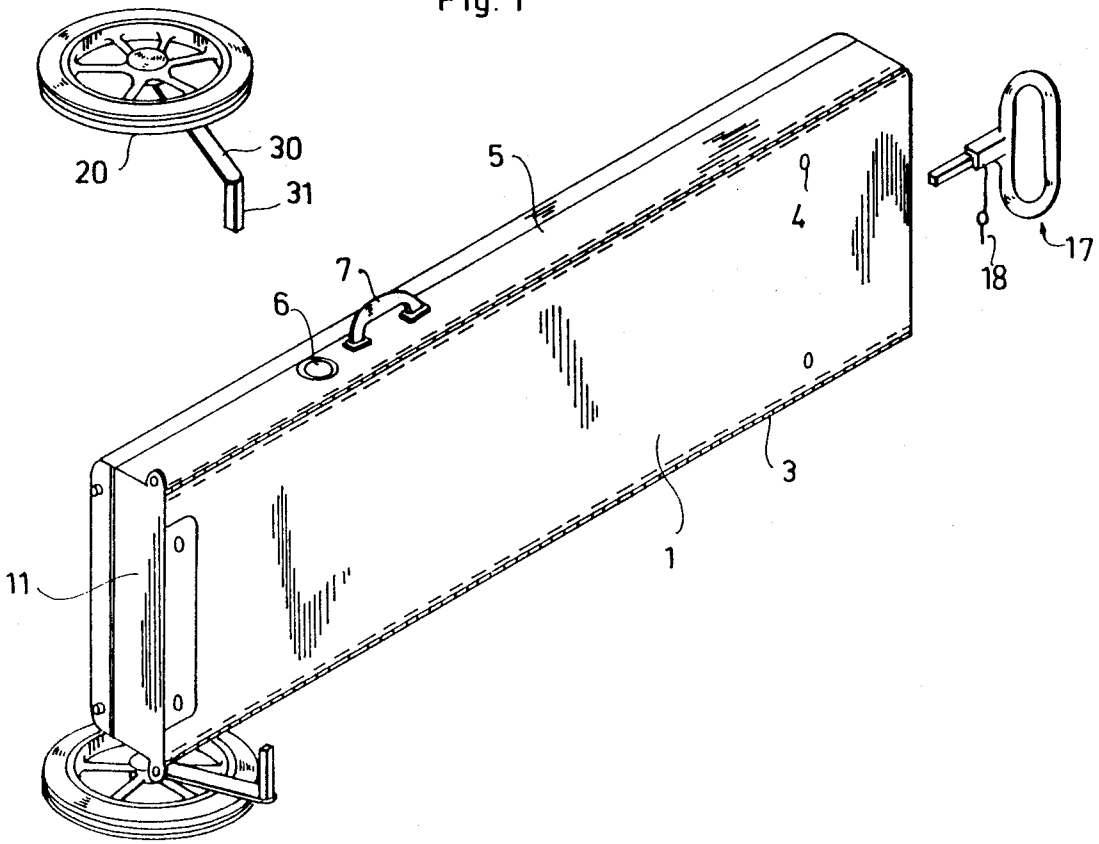

The invention relates to a suitcase for arranging golf equipment, of a type convertible to a golf cart for transporting this equipment on a golf course.

Golf clubs are traditionally arranged in bags intended to be carried on a cart while travelling over a golf course. These carts are conceptually very simple and comprise principally a tubular frame bearing a handle near one of its extremities and mounted on two oblique arms each carrying a wheel. Upon this frame are, additionally, arranged support members intended to assure that the bag is retained. In spite of their simplicity, these carts nevertheless have several inconveniences. In the first place, the weight of this cart is added to the weight of the bag enclosing the clubs. While these two elements are each of a relatively light weight, when combined they form an assembly which is relatively heavy to be drawn along if one considers that a golf course requires several kilometers of walking. Moreover, from their conception, these carts are relatively cumbersome and thus present sizeable problems of arrangement and transportation. Finally, the last difficulty comes from the fact that the clubs are arranged loosely in a bag. In effect, the choice of a club requires searching among the entanglement of club heads for the one desired, and then withdrawing this one longitudinally from the length of the bag.

To overcome these disadvantages, several solutions have been proposed, seeking to resolve one or the other problem.

One solution permitting resolution of the problem of the cumbersomeness, and thus the arranging of the carts, has comprised obtaining carts which are partially disassemblable or foldable, in such a manner to permit their transport, especially in the trunk of a car. However, the addition of mechanical elements permitting the folding works in opposition to the fundamental qualities of traditional carts, their light weight and simplicity. Moreover, the clubs are often arranged in a bag intended to be fixed upon such carts.

Another solution, such as described in U.S. Pat. No. 3,164,393, comprises providing a club holder able to be fixed to a conventional cart. This detachable club holder comprises ratchet members permitting arranging the iron clubs parallel with respect to the others and the tubular elements extending parallel to each other with respect to the others, intended to lodge the woods. This club holding device permits rapid selection of the desired club. However, being intended to be fixed to a cart, it does not resolve the problems stemming from the use thereof. Moreover, these iron club support members are arranged in such a manner that these clubs are arranged with their heads arranged toward the top, that is, in a position inverse to that in which they have a natural tendency to assume as a result of their arrangement. For this reason, the club holding device must necessarily be provided with retaining members for avoiding the clubs coming loose when the cart is being pulled.

The elimination of the bag has also lead to the realization of suitcases for arranging golf equipment, convertible to a cart for transporting this equipment over a golf course. The goal intended by these inventions is to permit the easy transport of golf equipment in a suitcase convertible by means of several simple operations to a cart in which the clubs are separated one from another and easily selectable. However, none of these solutions proposed permit combining the primary qualities sought: lightweight, balancing of the weight carried with respect to the axis of the wheels, easy withdrawal of the clubs and automatic stability of the cart in its rest position.

A first type of suitcase, such as described in French Pat. No. 1,292,249 and U.S. Pat. No. 4,017,091 comprises a rigid case provided with longitudinal grooves opening at the level of the face of the upper extremity of the suitcases and in which the clubs may be engaged. One device for detachably fixing permits mounting two wheels at the level of the face of the lower extremity of the suitcase. The disadvantages of such a cart are of three types: in the first place, the clubs are inserted in the longitudinal grooves which requires disengaging them over their full length for extracting them from the cart. Further, by reason of this arrangement of the clubs, the head at the top on the side of the handle, the center of gravity of the load is found situated in the area of this handle. This leads to a very unfavorable weight distribution, since the user supports a large part of the weight when pulling the cart. There follows an unacceptable fatigue for a golfer who must be in position of all physical means during the entire game of golf. Finally, it is necessary to provide a manually actuated support in order to arrange the cart either in the pulling position or its rest position.

Another type of suitcase, such as described in German Pat. No. 2,939,150, British Pat. No. 2,096,546, and U.S. Pat. No. 2,590,178 permits resolving two of the latter disadvantages. In effect, the means for fixing the wheels permits positioning them in an intermediate position between the two faces of the end of the suitcase. This improvement permits obtaining a better equilibrium of the masses and, as a result, improving the comfort of the golfer when pulling the cart. However, these club heads are always positioned adjacent the handle, which leads to the above mentioned disadvantage and requires positioning the wheels relatively near this handle in such a manner as to obtain a convenient balancing of the weights. As a result, the support arms are necessarily rather long and cumbersome in order to avoid the base the suitcase coming into contact with the ground when the cart is being pulled.

A last type of suitcase, such as described in U.S. Pat. No. 3,738,677 permits disengaging the upper face of the cart in such a manner as to permit a rapid withdrawal of the clubs ratcheted on holding members permitting arranging them parallel to this upper face. To this effect, this suitcase comprises two compartments, upper and lower, articulated around an axis of rotation, so as to be able to be pivoted between two positions: a closed position where they form a transporting suitcase for golf equipment, and an open position where these compartments are turned down one against the other, permitting a direct access to the clubs. In this open position, the wheels are then mounted at the level of the face of the lower extremity of one of the compartments. The solution proposed for permitting an easy access to the clubs thus leads to the detriment of the balancing of weights with respect to the position of the wheels. This cart remains though very easy to pull, and this in spite of the arrangement of the iron clubs in which the heads are arranged near the wheels.

No type of suitcase exists which thus permits satisfying, completely, all of the required features conceived for a golf cart. Moreover, it is to be noted that all of these convertible suitcases have a weight at least equal and often greater than the weight of the assembly of a bag-cart and are, this weight and their dimensions, much less manageable than a conventional cart.

The present invention proposes to provide an arranging case convertible to a golf cart overcoming all of the disadvantages indicated above.

To this effect, the present invention proposes to furnish a suitcase of relatively reduced dimensions convertible to a very lightweight and manageable golf cart due to the addition of wheels positioned in such a manner as to balance the weight of the clubs.

Another object is to permit a direct access to the clubs without having to withdraw each of them along its length.

Another object is to provide a cart which dampens shocks, in particular when used on uneven ground.

(In order to simplify the description, the suitcase will be described in an inclined position corresponding to the pulling position or the rest position of the cart. The terms "upper", "lower", "top", "bottom" are therefore used with reference to the plane of rolling of this cart).

The suitcase provided by the invention for arranging golf equipment is of the type convertible to a cart for transporting the said equipment over a golf course. It is characterized in that it comprises in combination:

(a) a covering defining a rectangular parallelepipedic volume, of a height which is slight with respect to its length and its width and comprising:

two large opposed faces, upper and lower, of which one, the upper, is provided with opening means adapted to disengage it on its greatest surface, two small opposed extremity faces, termed top and bottom, of which one, the top, is provided with opening means adapted to disengage it on its greatest surface, two lateral, opposite faces, each provided with an opening arranged in its lower half.

(b) two internal transverse walls extending between the lateral faces and arranged at a distance one from the other less than the length of a club, the internal wall near the bottom extremity face being positioned a distance from said extremity face adapted to permit the lodging of the heads of the clubs, (c) support and holding members adapted to arrange the clubs in parallel one to the other in two planes essentially parallel to the large faces, said support members comprising:

notches provided at the level of the upper edge of the internal walls, and of a form adapted to permit retaining the clubs, so that the head of said clubs is lodged in a recess by the internal wall and the bottom extremity face, an assembly of tubular elements carried by the internal walls and extending parallel one with respect to another in proximity to the lower face, the tubular elements being of a form adapted to each lodge a club, (d) an internal closing structure adapted to assure a rigid retention of the cover in an approximately rectangular parallelepipedic form, the structure being connected to the internal walls, (e) a longitudinal standard fixed to the internal walls and extended between the extremity faces, said standard being provided, toward one extremity situated opposite the upper extremity face, with detachable fixing means for the rapid mounting of a member for handling and maneuvering, (f) an axle fixed on a portion of the mounting situated between the internal walls, in such a manner as to extend transversly between the openings of the lateral faces, said axle comprising a transverse tubular member having detachable fixing means for rapidly mounting it, between the parts of the suitcase, wheels arranged in such a manner that the bottom extremity face is situated above the plane of rolling of said wheels in an inclined pulling position.

The combination of these characteristics permits obtaining a very lightweight suitcase, of reduce dimensions (arrangement of the clubs), convertible to a very manageable cart because of the position of the wheels which permits balancing the weight of the clubs. Moreover, once the upper face is opened, the clubs are directly accessible.

The rigidity of this suitcase is assured by a lightweight internal reinforcing structure preferably comprising a rigid skeleton extending along the sides of a rectangular parallelepiped, and fixed in proximity to the angles of the internal walls.

Further, the mounting is preferably positioned in the longitudinal plane of symmetry of the suitcase. The notches and tubular elements are thus distributed symmetrically from one part to the other of this mounting, in such a manner as to assure a good transverse distribution of the load.

Further, the compartments for arranging small equipment may be advantageously created between the internal walls in providing, a removeable cover parallel to the upper face and carried by the transverse walls in the notches thereof.

Figure 2:
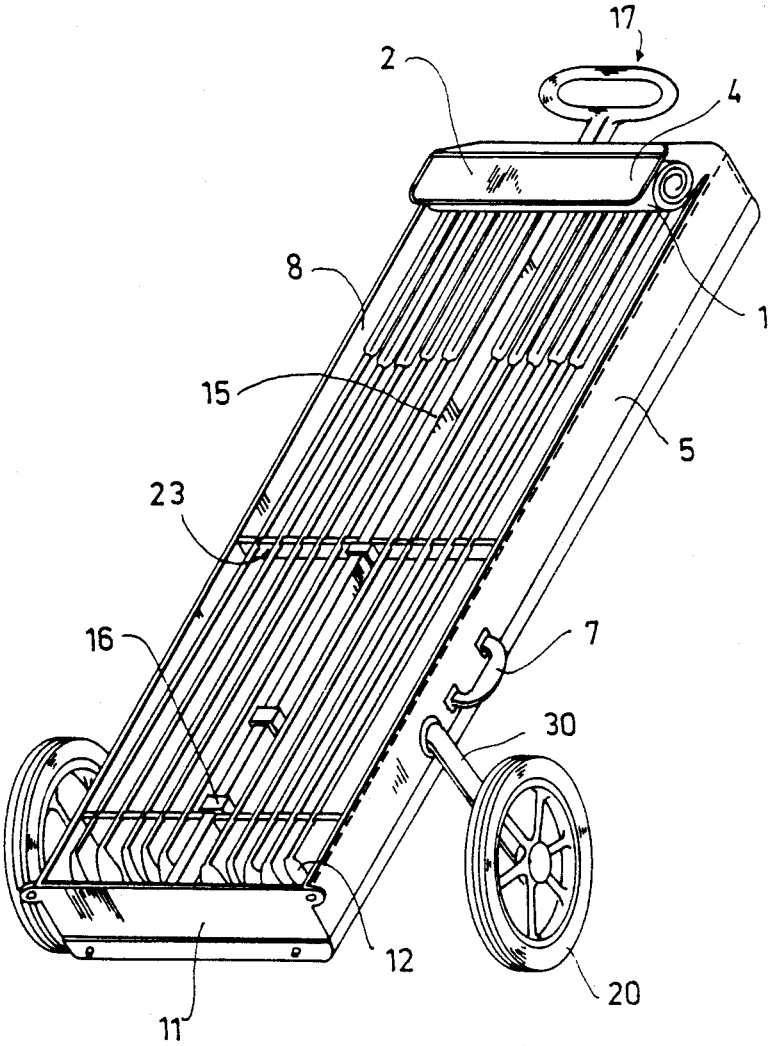
Figure 3:
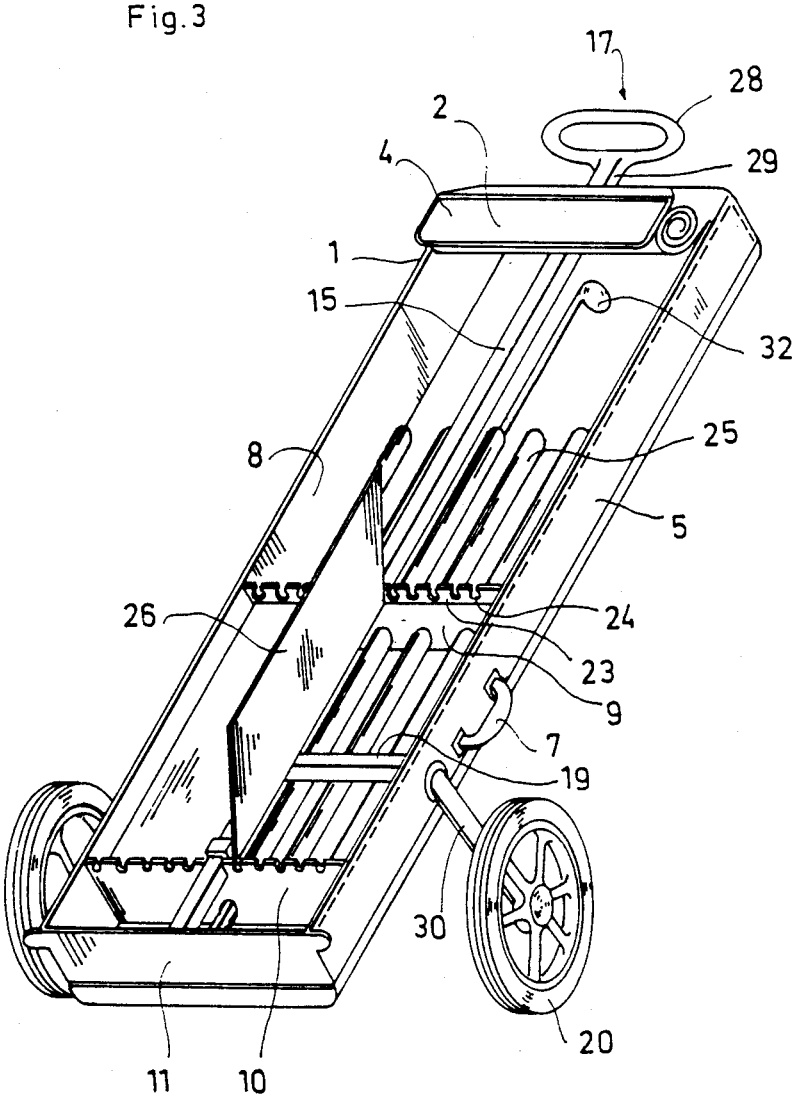
Figure 4:
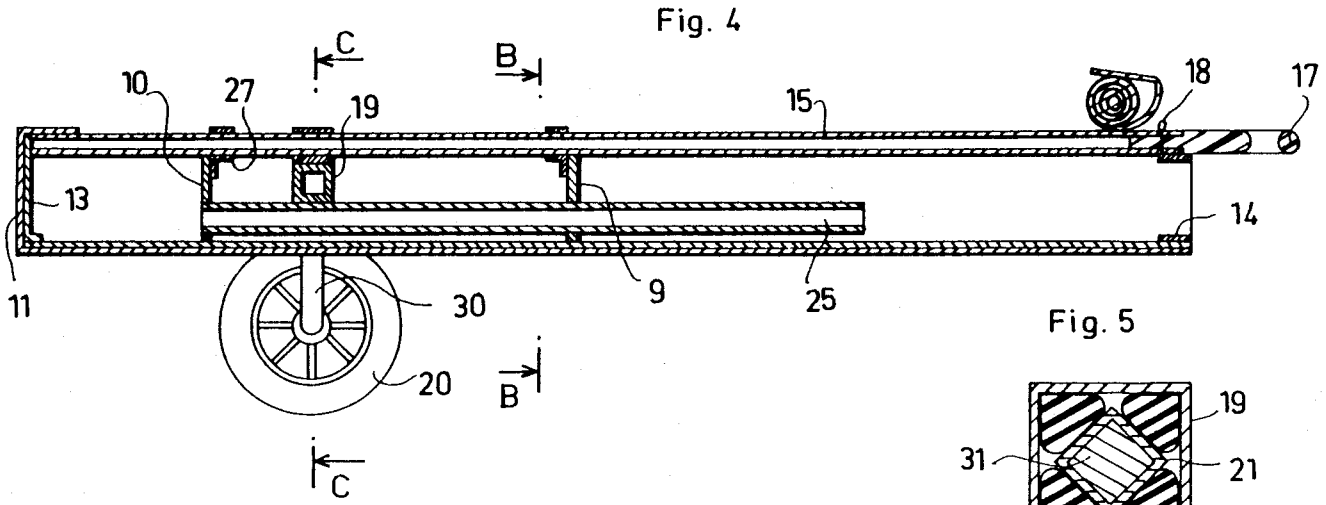
Figure 5:
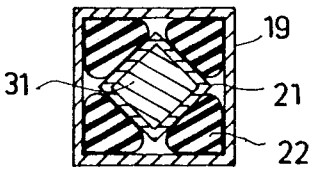
Figure 7:
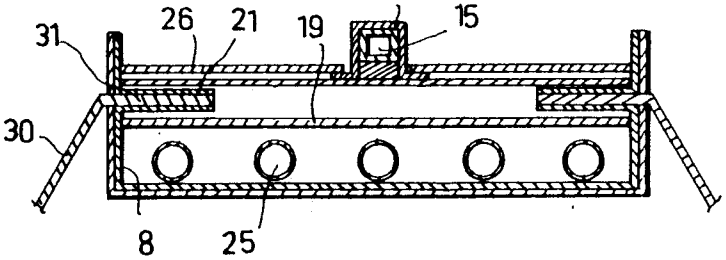
Figure 6:
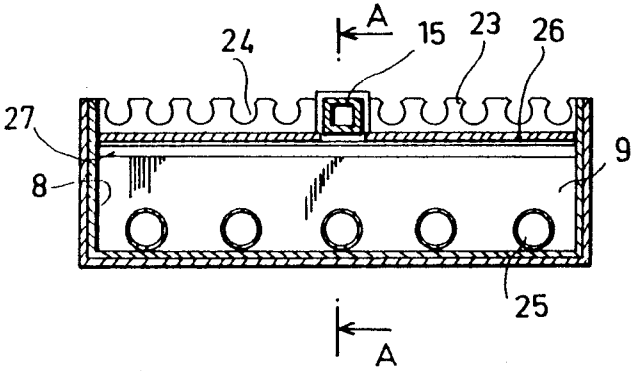

Other characteristics and advantages of the invention will become apparent from the detailed description which follows and upon examination of the attached drawings which show, by way of non-limiting example, a preferred embodiment. In the drawings which are an integral part of the present description:

FIG. 1 is an exploded perspective view of a suitcase, of a pulling and maneuvering handle, and of wheels in accordance with the invention, FIG. 2 is a perspective view, wheels and gripping and maneuvering handle mounted, the upper and top faces of the suitcase being removed, FIG. 3 is a perspective view of the empty cart, an access cover of a compartment for arranging small equipment being open, FIG. 4 is a longitudinal sectional view along plane A—A, FIG. 5 is a transverse sectional view of the extremity of the axle, FIG. 6 is a transverse sectional view of the cart along plane B—B, FIG. 7 is a transverse sectional view along plane C—C, FIG. 8*a* through 8*d* are schematic perspective views illustrating different phases permitting the conversion of the suitcase into a golf cart.

The suitcase for arranging golf equipment shown in FIG. 1 is of a type convertible to a golf cart for transporting this equipment over a golf course, such as shown in FIGS. 2–7.

This suitcase comprises a covering defining a rectangular parallelepipedic volume of a height which is slight with respect to its length and its depth. These dimensions are on the order of 1.15 m long by 0.33 m wide and 0.12 m high. This covering is comprised of a composite material having an impermeable external surface and an internal surface of an alveolar structure such as foam. The large upper face 1 and the face of the top extremity 2 are each provided with two lateral closing guides such as 3, permitting disengaging them on their greatest surface. The upper surface 1 may thus be rolled on itself in a direction of the top face 2, this being then turned under on this rolled upper face. These two faces are finally retained by means of a system of snaps 4 adapted to cooperate in this open position.

The lateral faces 5 are each provided in opposition with an opening 6 arranged in their lower half.

The rigid maintenance of this covering in its rectangular parallelepipedic form is assured by an internal reinforcing structure 8 comprising a skeleton of rigid material. This skeleton comprises three full faces, of a material such as "Plexiglas", extending respectively against the lateral faces 5 and the lower face of the suitcase. It is further rigidified by a transverse frame 14 arranged at the level of the top extremity 2.

An external handle 7 handling is provided on one of the lateral faces 5, in the vicinity of the center of gravity of the suitcase when it encloses the clubs. This handle is fixed on the reinforcing skeleton 8 through the covering.

On the interior of this suitcase are arranged two transverse walls 9, 10 extending internally between the lateral faces 5 and situated at a distance from each other less than the length of a club. The lower internal wall 10 is, further, positioned at a distance from the bottom extremity 11 of the suitcase such as to permit the lodging of the head of the clubs 12.

Each extremity of these internal walls 9, 10 presents a square angle permitting them to be glued against the opposing face of the reinforcing skeleton 8, in order to assure the indeformability of the suitcase.

Another reinforcing wall 13 is also arranged at the level of the bottom extremity of the suitcase; this reinforcing wall 13 glued to the bottom extremity face 11 is provided itself with square angles able to be glued to the internal structure 8.

A tubular standard 15 is additionally fixed to the transverse internal walls. This standard 15 extends longitudinally between the faces of the extremities 2, 11, in the plane of longitudinal symmetry of the suitcase. It is fixed, at one end, as indicated above to each of the internal walls 9, 10, by means of fixation flanges 16 and, on the other hand, to the reinforcing structure 14 arranged at the level of the top extremity of the suitcase.

Toward its top extremity, the standard is provided with removeable fixation means for the rapid mounting of a gripping and maneuvering member 17; this fixation means comprises, by way of example, two bores provided opposite each other, in the upper and lower walls of the standard 15 and adapted to receive a pin 18.

In its lower half section between the internal walls 9, 10, the standard 15 bears an axle 19 comprising a transverse tube extending between the openings 6 of the lateral faces 5 of the suitcase. This axle 19 comprises, at each of its extremities, detachable fixing means for quickly mounting a wheel 20.

This fixing means comprises a suspension element comprising a hollow member 21 lodged in the axle 19 at the level of each of its extremities, this member being retained by means of elastic packings 22.

The suitcase also comprises support members and golf club retaining members, adapted to arrange the iron clubs 12 parallel to each other, in the vicinity of the upper face 1 of this suitcase, and the wood clubs 32 parallel to each other in the vicinity of the lower face.

The support members and retaining members for the iron clubs 12 comprise two bands 23 of a semi-rigid material such as Neoprene, each fixed on the upper edge of an internal wall 9, 10, and provided with notches 24 arranged symmetrically on opposite sides of the central standard 15, permitting the fastening of the clubs.

The iron clubs 12 are thus maintained in the notches 24, the head lodged between the faces of the extremity 11 and the lower internal wall 10, in an arrangement where they are directly accessible from the upper face 1 of the suitcase.

The support and retaining members for the wood clubs 32 comprise tubular elements 25 extending parallel to the lower face of the suitcase in the vicinity thereof. These elements are five in number, one being positioned adjacent the central standard 15 and the four others being symmetrically arranged on one side or the other of this standard. This arrangement permits a symmetrical distribution of the wood clubs 32 and regardless of their number, paired or not paired. Further, the maximum number of wood clubs used being generally four, the fifth tubular element may also serve to lodge an accessory such as an umbrella.

The tubular elements 25 are carried by the internal walls 9, 10 provided for this reason with openings in their lower half. They extend from the lower internal wall 10 in the direction of the top extremity face 2 of the suitcase and thus permit introducing the wood clubs 32 from this extremity face 2, the head being oriented toward the top.

It should be noted that the internal reinforcing structure 8, the internal walls 9, 10 and even the support and retaining members 23, 24, 32 for the clubs may also be produced from a single operation by molding or injection of plastic material.

In the last place, the suitcase comprises two compartments for arranging small pieces of equipment closed by covers 26 removeably arranged between the internal walls 9, 10 on opposite sides of the central standard 15. These covers 26 are carried by the angle brackets 27 fixed on the internal walls 9, 10 on the notches 24 thereof.

With the suitcase are associated two wheels 20 and a gripping and maneuvering element 17 intended to be mounted by means of a simple manipulation for transforming the suitcase into a golf cart. The handling and gripping element 17 is intended to be mounted in the extension of the central standard 15 in such a manner as to be easily gripped with respect to the top extremity face 2 of the suitcase. This member 17 comprises a handle 28 carried by a profile 29 of a section conjugate to the internal section of the central standard 15, so as to be able to be inserted therein.

This profile 29 is provided with a transverse opening arranged in such a manner as to be found opposite openings provided toward the upper extremity of the standard 15, in a position so as to mount the handle of this element 29. The blocking of the gripping and maneuvering member 17 is assured by a pin 18 which projects into the said opening.

In order to remove this manipulating member, one may thus either separate it from the central standard 15 or push it into the profile 29 at the interior of this standard 15 in such a manner that the handle 28 does not project from the top extremity face 2. In this latter case, the pin 18 may be replaced by a retractable pion which comes to be lodged in an opening provided in the standard 15 or by equivalent longitudinal blocking means for the profile 29 on the standard 15.

The wheels 20 of the cart are low pressure wheels presenting low pressure on the ground, which permits rolling over any areas of a golf course without leaving tracks on the ground.

Each wheel 20 is carried by an arm 30 extending obliquely with respect to the axis of rotation thereof. The arms 30 comprise an angled extremity 31 of a cross section conjugate to the internal cross section of the hollow members 21 lodged in the extremity of the axle 19 and arranged in such a manner as to position the arm 30 in the same plane, orthogonal to the longitudinal axis of the standard 15.

Each wheel 20 is thus carried by the intermediary of a suspension element which permits absorbing the shocks subjected by this wheel notably when the cart is used over uneven terrain, facilitating and making easier the pulling of this cart.

Further, the longitudinal position of the axle 19 and the arrangement of the wheels 20 are designed in such a manner that the bottom extremity face 11 of the suitcase is situated above the plane of rolling of these wheels for an inclination between the lower face of the suitcase and the plane of rolling essentially less than 45°.

This arrangement associated with the fact that the iron clubs 12 are arranged with their heads downwardly, permits obtaining the two following advantages: first, the cart is stable in its rest position and does not need the addition of a support element such as a prop, and also, in the pulling position, the center of gravity of the weight is located essentially at right angles in the axle 19. The effort supported by the user is thus very slight.

FIGS. 8*a* to 8*d* illustrate the different steps permitting the conversion of the suitcase to a golf cart.

During its transport (FIG. 8*a*), the suitcase has numerous advantages by virtue of its reduced dimensions, its low weight (on the order of 10 kilograms when it contains 10 golf clubs), and the position of the gripping handle 7 which assures its stability.

Figure 8A:
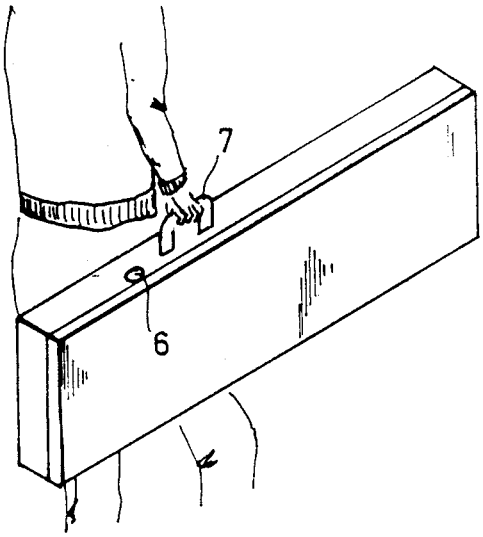
Figure 8B:
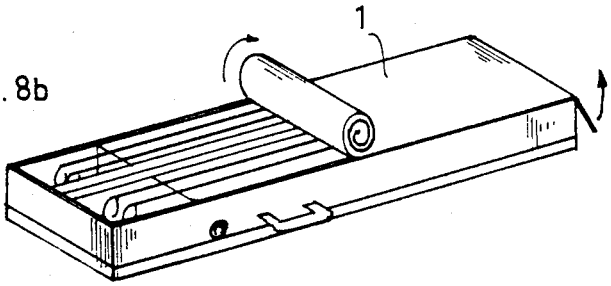
Figure 8C:
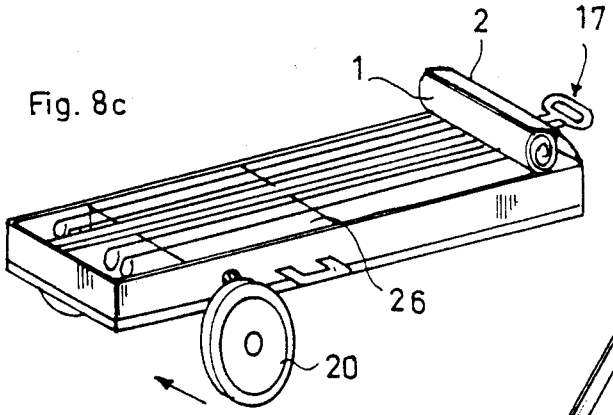
Figure 8D:
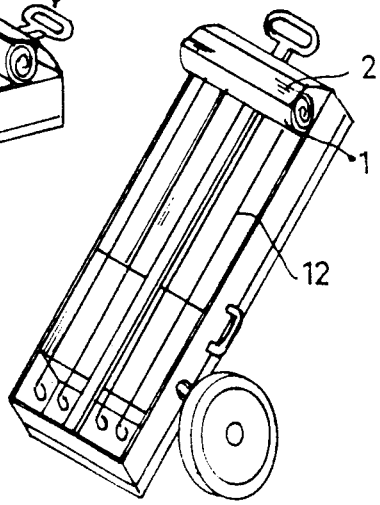

The conversion of this suitcase to a golf cart is accomplished very easily by means of three simple manipulations:

opening the upper face 1 and then the top extremity 2 (FIG. 8*b*), mounting the two wheels 20 and the gripping and manipulating handle 17 simply inserting the hollow members 21 and the extremity of the central standard 15 without interposing mechanical members (FIG. 8*c*). It should be noted that the wheels 20 and eventually the gripping and maneuvering member 17 may be arranged in the pockets provided for this purpose on the external side of the lower face of the suitcase or more basically in a separate bag of small dimensions.

These operations permit obtaining a very lightweight and maneuverable cart in which the iron clubs 12 are directed accessible from the upper face 1.

I claim:

1. A suitcase for golf equipment convertible to a cart for transporting said equipment over a golf course, said suitcase comprising in combination:

a covering defining a rectangular parallelepipedic volume of a height less that its length and its width and including opposed upper and lower faces, the upper face (1) being provided with disengageable opening means (3) adapted to be disengaged from said upper face, two opposed lateral faces (5) each having an opening (6) arranged in the lower half thereof, and opposing top and bottom end faces, said top end face including opening means (3) disengageable from said upper face (1), two internal transverse walls (9, 10) extending between the lateral faces (5) and spaced a distance from each other less than the length of a club, the internal wall (10) near the bottom end face (11) being spaced a distance from said end face to house the heads of clubs (12), support and retaining members (23, 24, 25) adapted to arrange the clubs (12, 13) parallel to each other in two planes essentially parallel to the upper and lower faces, said support members comprising notches (24) in the upper edge of the internal walls, (9, 10), and of forms adapted to permit securing the clubs (12) in such a manner that the head of the clubs is housed in the space defined by the internal wall (10) and the bottom end face (11), a plurality of tubular elements (25) carried by the internal walls (9, 10) and extending parallel to each other in proximity to the lower face, said tubular elements each being of a form such as to house a club (32), an internal reinforcing structure (8) for maintaining the covering in a substantially rectangular parallelepipedic form, said structure being connected to said internal walls (9, 10), a longitudinal standard (15) fixed to the internal walls, (9, 10) and extending between said end faces (2, 11), said standard being provided, toward one end opposite the top end face (2), with securing means for rapidly mounting a gripping and maneuvering member, an axle (19) fixed on a portion of the standard (15) situated between the internal walls (9, 10), in such a manner as to extend transversely between the openings (6) of the lateral faces (5), said axle comprising a transverse tubular member provided with securing means (21, 22) for rapidly mounting wheel members (20) on opposite sides of the suitcase in such a manner that the bottom end face (11) is situated above the plane of rolling of said wheels in a inclined pulling position, said securing means for each wheel comprising a suspension member including a hollow member (21) mounted at the extremities of the axle (19) and maintained therein by means of elastic seals (22), and each wheel (20) being carried by an arm (30) having an angled end (31) with a cross-section complementary to the internal section of the member (21).

2. A suitcase as in claim 1 and wherein the longitudinal position of the axle (19) upon the standard (15), and the wheel members (20) are arranged such that the bottom end face (11) of the suitcase is situated above the plane of rolling of the wheels (20) for an inclination between larger faces and the plane of rolling of essentially less than 45°.

3. A suitcase as in claim 2, and wherein said standard (15) is positioned in the longitudinal plane of symmetry of said suitcase, said notches (24) and said tubular elements (25) being spaced symmetrically on opposite sides of said standard 4. A suitcase as in claim 3, comprising a supplemental tubular element (25) arranged directly above or below the standard (15).

5. A suitcase as in claim 4 and wherein the internal reinforcing structure (8) comprises a rigid framework extending along the sides of a rectangular parallelepiped and fixed in proximity to the angles of the internal walls.

6. A suitcase as in claim 5, and including a transverse reinforcing wall (13) connected to the bottom end face (11) and the internal reinforcing structure (8).

7. A suitcase as in claim 6 and including on opposite sides of the standard (15), a removeable cover (26) parallel to the large faces and supported by the transverse internal walls (9, 10) on the notches (24) thereof, in such a manner as to define a compartment for arranging small equipment between said internal walls, 8. A suitcase as in claim 7, and wherein the arms (30) of the wheels (20) extend obliquely with respect to the axis of rotation of said wheels, said securing means (21, 22) and the angled extremity (31) of the arms being arranged with said arms in the same plane orthogonal to the longitudinal axis of the standard (15).

9. A suitcase as in claim 3 and wherein the covering comprises an external surface of an impermeable material and an internal surface of an alveolar structure.

10. A suitcase as in claim 3 and including a gripping handle (7) arranged upon one of the lateral faces (5), in the vicinity of the center of gravity of said suitcase when enclosing clubs, said handle being fixed to the reinforcing framework through said covering.

11. A suitcase as in claim 1 and wherein the opening means of the upper larger face (1) and of the top end face (2) comprise slide closures (3) disposed laterally on said faces in such a manner as to permit:

rolling the upper face (1) in a direction toward the top end (2), turning down the top end (2) on the upper face (1), in the rolled position thereof, said upper and end faces being provided with a system of snaps (4) arranged in such a manner as to cooperate in the open position of said faces.

* * * * *